United States Patent [19]

Triezenberg

[11] Patent Number: 4,836,083

[45] Date of Patent: Jun. 6, 1989

[54] ALTERNATOR FOR RAPID REPETITIVE PULSING OF AN ELECTROMAGNETIC LAUNCHER

[75] Inventor: David M. Triezenberg, Wilkins Township, Allegheny County, Pa.

[73] Assignee: Westinghouse Electric Corp., Pittsburgh, Pa.

[21] Appl. No.: 403,955

[22] Filed: Aug. 2, 1982

[51] Int. Cl.[4] ..... F41F 1/02; H02K 16/00; H02K 19/16

[52] U.S. Cl. ..... 89/8; 124/3; 310/13; 310/112; 310/114; 310/162; 310/184

[58] Field of Search ..... 89/8; 124/3; 310/10, 310/13, 12, 40 R, 46, 111, 112, 114, 118, 143, 148, 159, 162, 164, 166, 183, 184, 186, 178–180, 195, 198, 200, 201, 206–208, 210

[56] References Cited

U.S. PATENT DOCUMENTS

| | | | |
|---|---|---|---|
| 3,173,042 | 3/1965 | Fodor | 310/114 X |
| 3,321,653 | 5/1967 | Sonoyama | 310/180 |
| 3,419,905 | 12/1968 | Letter | 310/180 X |
| 3,456,142 | 7/1969 | Larsen | 310/180 |
| 3,483,410 | 12/1969 | Siegelman et al. | 310/114 |
| 3,898,491 | 8/1975 | Long et al. | 310/183 |
| 3,940,646 | 2/1976 | Buckman | 310/166 |
| 3,944,865 | 3/1976 | Jewitt | 310/178 |
| 3,974,396 | 8/1976 | Schonball | 310/118 X |
| 4,086,506 | 4/1978 | Kustom et al. | 310/178 |
| 4,115,915 | 9/1978 | Godfrey | 310/180 X |
| 4,138,619 | 2/1979 | Broadway et al. | 310/184 |
| 4,292,553 | 9/1981 | Deputato | 310/112 X |
| 4,319,168 | 3/1982 | Kemeny | 124/3 |
| 4,329,609 | 5/1982 | Allegre et al. | 310/183 |
| 4,329,971 | 5/1982 | Kemeny et al. | 124/3 |
| 4,432,333 | 2/1984 | Kurherr | 89/8 |
| 4,458,577 | 7/1984 | Fisher et al. | 89/8 |

OTHER PUBLICATIONS

Proceedings of the Second Hypervelocity and Impact Effects Symposium, vol. I, 12/57, Sponsored by US Naval Res. Lab. and Air Res. and Dev. Com., p. 139.

DTIC Technical Report AFATL-TR-81-99, published 11/81 and 7/82, pp. 4, 28, 63–70 and 78.

*Primary Examiner*—David H. Brown
*Assistant Examiner*—John E. Griffiths
*Attorney, Agent, or Firm*—R. P. Lenart

[57] ABSTRACT

An alternator for repetitive pulsing of an electromagnetic projectile launcher is provided with a stator structure having at least one pair of single layer concentric coil portions which are electrically connected in parallel. A rotating magnetic field induces a voltage in these coil portions without producing circulating currents. The alternator is connected through a switch to a pair of genrally parallel conductive projectile launching rails and a sliding conductive armature between the rails. By causing the switch to conduct at a predetermined phase angle, the voltage across the launching rails can be reduced to zero as the projectile leaves the rails. Where a succession of projectiles is to be fired, the phase angle at which the switch begins to conduct is controlled in order to achieve a substantially constant muzzle velocity for each projectile while minimizing the rail voltage as each projectile exits the rails.

16 Claims, 2 Drawing Sheets

ALTERNATOR FOR RAPID REPETITIVE PULSING OF AN ELECTROMAGNETIC LAUNCHER

STATEMENT OF GOVERNMENT INTEREST

The United States Government has rights in this invention pursuant to Contract No. F08635-81-C-107 with the Department of Defense.

BACKGROUND OF THE INVENTION

This invention relates to electromagnetic projectile launchers and more particularly to electromagnetic launchers which utilize an alternator as a source of high current to launch one or more projectiles wherein the projectile muzzle velocity can be controlled by controlling the phase angle at which current is switched from the alternator to a pair of projectile launching rails.

Electromagnetic projectile launchers are known which comprise: a pair of generally parallel conductive projectile launching rails; a source of high current; means for switching current from the high current source to the projectile launching rails; and a sliding conductive armature between the rails. Current flow through the rails and armature places an electromagnetic force on the armature which is used to propel the armature and a projectile along the rails. Launchers have been constructed with a high current source which included the series connection of a direct current homopolar generator and an inductive energy storage coil. To launch a projectile, the inductor is initially charged to a predetermined current level through a switch which acts as a short across the projectile launching rails. Then the switch is opened to allow the inductor to discharge through the rails and armature, thereby launching the projectile. These launchers require massive switching systems and additional components to suppress an arc which occurs as the projectile leaves the launching rails. If multishot operation is desired, current switch-off requirements at the muzzle become excessive.

An A.C. generator, or alternator, is an attractive alternative power source for rapid firing electromagnetic launchers since an alternator is self-commutating. By appropriately timing the switching of current to the launcher rails, the alternator can provide the electromotive force necessary to bring current to zero as the projectile leaves the barrel, thereby greatly reducing the required arc suppression circuitry and simplifying the switching system. Current pulses which are used to launch projectiles may be provided every cycle, or every several cycles, depending on the desired pulse rate.

SUMMARY OF THE INVENTION

An alternator for use in an electromagnetic projectile launching system constructed in accordance with the present invention comprises: a stator structure having an internal space; at least one pair of single layer concentric coil portions disposed adjacent to the circumference of the space and electrically connected in parallel; and means for producing a rotating magnetic field within the space, thereby inducing a voltage in the pair of coil portions. The coil portions are positioned such that circulating currents due to the induced voltage are eliminated. To provide the best match of the alternator to a parallel rail electromagnetic projectile launcher load, the stator winding comprises a plurality of pairs of concentric single layer coil portions connected in as many parallels as possible. Reaction torques are minimized during launcher firing by utilizing two counter-rotating rotors each producing a rotating magnetic field to induce a voltage in separate stator windings in a single stator structure. The separate stator windings are connected in parallel, thereby causing the counter-rotating rotors to rotate synchronously and eliminating circulating currents within the stator windings.

An electromagnetic projectile launcher constructed in accordance with the present invention utilizes the described alternator and further comprises: a pair of conductive projectile launching rails; means for conducting current between the rails and for propelling a projectile along the rails; and means for switching current from the alternator to the projectile launching rails wherein the current is switched at a preselected phase angle such that the current goes to zero as the projectile exits from the projectile launching rails. The operation of this electromagnetic launcher is in accordance with a general method of electromagnetically accelerating a projectile, comprising the steps of: switching current from an alternating current source to a pair of projectile launching rails; and conducting current between the rails through a sliding conductive armature which is subject to an electromagnetic force and propels a projectile along the rails; wherein the switching occurs at a preselected phase angle such that current goes to zero as the projectile exits the launcher rails. Where a succession of projectiles is to be fired, the phase angle at which current is switched for successive projectiles is varied such that all projectiles achieve substantially the same muzzle velocity, in spite of a decrease in available source current, while minimizing current in the rails as each projectile exits from the rails.

DESCRIPTION OF THE PREFERRED EMBODIMENTS

Figure 1:
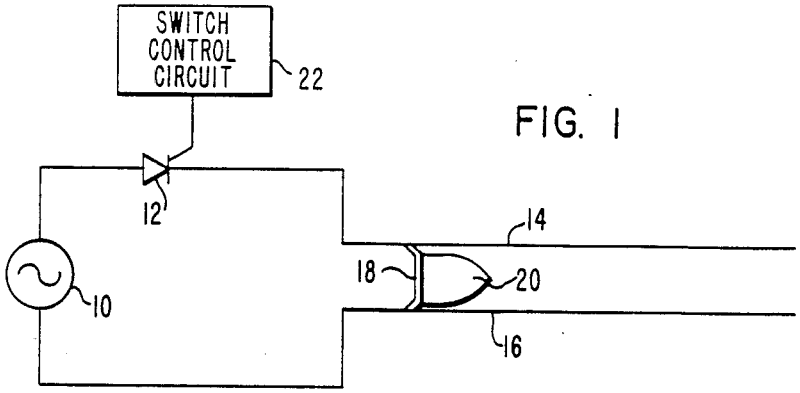
FIG. 1 is a schematic diagram of an electromagnetic projectile launcher constructed in accordance with one embodiment of the present invention.

Referring to the drawings, FIG. 1 is a schematic diagram of an electromagnetic projectile launcher constructed in accordance with one embodiment of the present invention. Alternator 10 is connected through switch 12 to a pair of conductive projectile launching rails 14 and 16. A sliding conductive armature 18 is disposed between projectile launching rails 14 and 16 and serves as means for conducting current between the rails and for propelling projectile 20 along the rails. The operation of switch 12 is controlled by switch control circuit 22 which insures that switch 12 begins to conduct at a predetermined phase angle such that current through rails 14 and 16 goes to zero as armature 18 exits at the muzzle end of the rails. Although switch 12 is shown as a single silicon controlled rectifier (SCR) it should be understood that because of the high currents involved, an actual switch may be comprised of a plurality of SCR's connected in parallel or an appropriate combination of solid state and mechanical switching elements.

Figure 2:
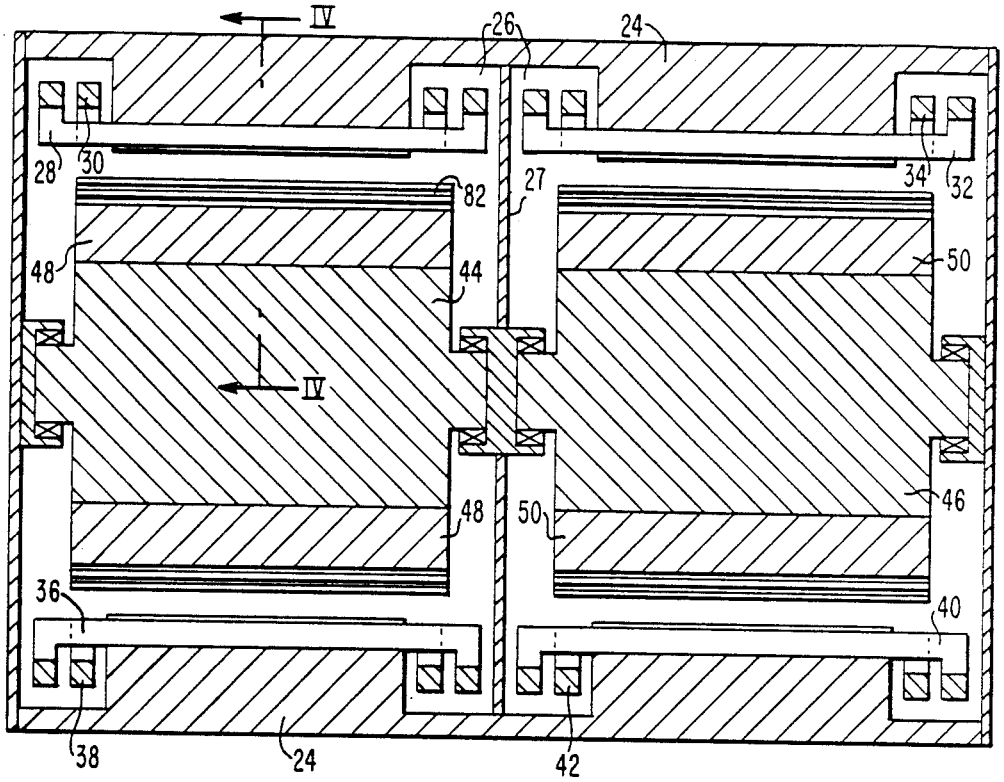
FIG. 2 is a cross-section of an alternator constructed in accordance with one embodiment of the present invention, for use in the launcher of FIG. 1.

FIG. 2 is a cross-section of a high current alternator in accordance with one embodiment of the present invention, for use in the launcher of FIG. 1. A stator structure 24 is shown as having an internal space extending on both sides of bearing support member 27. Stator conductors 28, 30, 32, 34, 36, 38, 40 and 42 are wound for single phase operation by being formed into pairs of single layer concentric coil portions disposed adjacent to the circumference of space 26. Two stator windings are used, wherein each of the stator windings comprise the parallel connection of a plurality of pairs of single layer concentric coil portions. These two stator windings are also connected in parallel. Rotors 44 and 46 are mounted along the central axis of space 26 and carry field windings 48 and 50, respectively. Current flow through these field windings is produced through conventional means such as brushless exciters or sliprings for connection to an external current source, not shown in this view. In order to minimize reaction torque during the firing of the launcher, rotors 44 and 46 are mounted such that they rotate in opposite directions thereby producing two rotating magnetic fields which rotate in opposite directions and induce voltages of opposite polarities in the associated stator windings.

Figure 3:
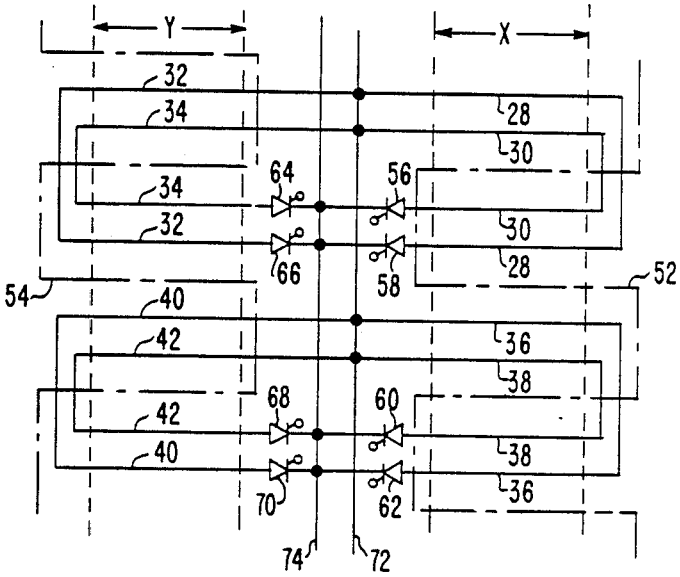
FIG. 3 is a partial wiring diagram of a developed cylindrical surface of the stator of the alternator of FIG. 2.

FIG. 3 is a partial wiring diagram of a developed cylindrical surface of the stator of the alternator of FIG. 2 which illustrates the electrical connections and relative positions of stator windings comprised of conductors 28, 30, 32, 34, 36, 38, 40 and 42. To prevent circulating currents, the conductors which form adjacent legs of the coil portions in each pair of single layer concentric stator coil portions are equally spaced in the active regions X and Y. For example, the distance between conductors 28 and 30 is kept constant in active region X. These active regions correspond to the area which is subject to a rotating magnetic field produced by current flowing through field windings in rotors 44 and 46. Each stator coil portion is formed by one conductor, for example 28 in Figure 3, which extends longitudinally along the stator adjacent to the circumference of the internal stator space in an active region, loops back, and extends longitudinally along the stator at a circumferentially displaced position in the active region. The longitudinally extending portions of the conductors which form one pair of concentric coil portions are symmetrically positioned on opposite sides of a common center line which also extends longitudinally along the active region of the stator, adjacent to the circumference of the space. For example, the common center line for the coil portions formed by conductors 28 and 30 of FIG. 3, coincides with the longitudinally extending portion of auxiliary winding 52 which lies mid-way between the two longitudinally extending portions of conductor 30 in the X active region. It should be understood that although only four pairs of single layer concentric stator coil portion are illustrated in FIG. 3, additional coil portion may be used. In any case, all of the coil portions are connected in parallel to achieve the best match of alternator characteristics to the electromagnetic projectile launcher load. By connecting the two stator windings in parallel, rotors 44 and 46 will rotate synchronously thereby preventing circulating current flow within the stator windings. Each of the illustrated stator coil portions is connected through one of the SCR's 56, 58, 60, 62, 64, 66, 68 or 70 to bus bars 72 and 74 which carry current to the projectile launching rails thereby forming complete coil loops.

Figure 4:
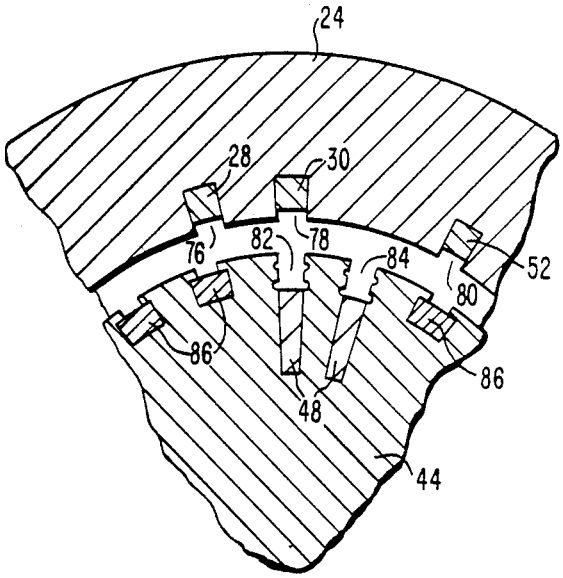
FIG. 4 is a cross-section of one pole pitch of the alternator of FIG. 2.

FIG. 4 is a cross-section of one pole pitch of the alternator of FIG. 2. Conductors 28 and 30 form one pair of single layer concentric stator coil portions and are held in place in axial slots 76 and 78 in stator structure 24. Auxiliary winding 52 is shown to be located in slot 80 in stator 24 and is displaced such that it can be connected in phase quadrature with the stator windings whereby the alternator can be motored up to speed from a two phase variable frequency supply. Field windings 48 are held in slots 82 and 84 in rotor 44. Damper windings 86 have also been provided in rotor 44 to ensure stable operation of rotor 44 and to minimize the effective reactance of the alternator during pulse discharge.

Figure 5:
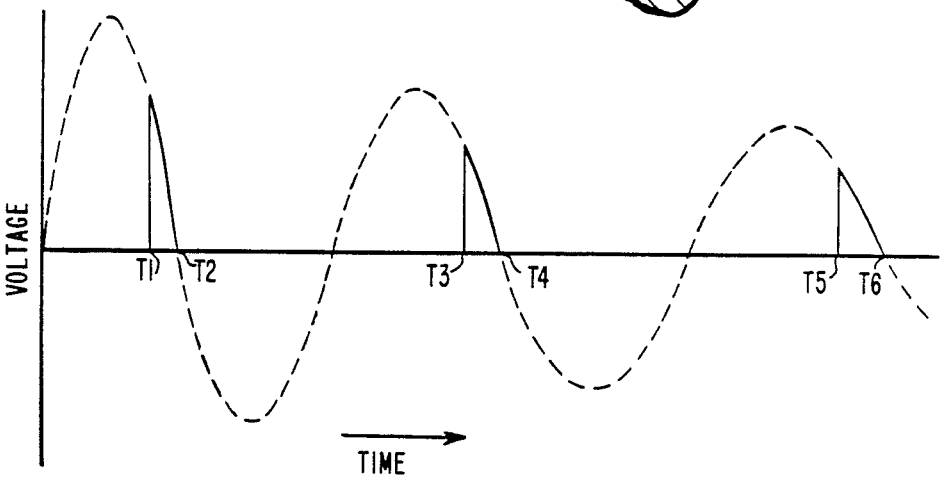
FIG. 5 is a waveform which illustrates current flow in the projectile launching rails of the launcher of FIG. 1 during the launch of a succession of projectiles.

The method of electromagnetically launching a series of projectiles utilized by the launcher of FIG. 1 can be described by reference to the voltage waveform of FIG. 5. In this figure, the voltage across alternator 10 is represented by a dashed line while the voltage across projectile launching rails 14 and 16 is represented by a solid line. If a single projectile is to be launched, switch 12 is triggered at time T1 at which time current begins to flow through rails 14 and 16 and armature 18, thereby propelling projectile 20 along the rails. At time T2, armature 18 exits the rails and the voltage across the rails has dropped to zero thereby eliminating the need for muzzle arc suppression devices. If a rapid succession of projectiles is to be fired, the alternator rotational speed will decrease significantly during the burst. However, substantially constant muzzle velocity can be maintained throughout the burst if the angle of pulse initiation is varied by controlling the gating of thyristor 12. Referring to FIG. 5, a second projectile can be launched by gating switch 12 at time T3 and a third can be launched by gating switc 12 at time T5. By controlling the angle of pulse initiation, the energy utilized in each launch can be maintained at a relatively constant value in spite of the decreasing output of alternator 10.

While there has been described what at present is considered to be the preferred embodiment of the invention, it should be understood that various modifications may be made therein without departing from the invention. For example, although the preferred embodiment utilizes counter-rotating rotors to minimize reaction torque, this invention also encompasses single rotor alternators. It is therefore intended that the appended claims cover all such changes that fall within the scope of the invention.

I claim:

1. An electromagnetic projectile launcher comprising:

a pair of conductive projectile launching rails;

a source of alternating current including: a stator structure having an internal space, a first pair of single layer concentric coil portions disposed adjacent to the circumference of said space, and means for producing a first rotating magnetic field within said space, thereby inducing a voltage in said first pair of coil portions;

means for electrically connecting said first pair of concentric coil portions in parallel;

wherein each of said coil portions includes a conductor which extends longitudinally along a first portion of said stator structure, loops back, and extends longitudinally along a second portion of said stator structure, said second stator portion being circumferentially displaced from said first stator portion;

means for conducting current between said projectile launching rails and for propelling a projectile along said rails; and means for switching current from said current source to said projectile launching rails, said current being switched at a preselected phase angle such that said current goes to zero as said projectile exits from said projectile launching rails.

2. An electromagnetic projectile launcher as recited in claim 1, wherein adjacent longitudinal sections of said conductors in a first one of said pair of concentric coil portions and in a second one of said pair of concentric coil portions are equally spaced in a circumferential direction to eliminate circulating currents due to said induced voltage.

3. An electromagnetic projectile launcher as recited in claim 1, further comprising:

a second pair of single layer concentric coil portions disposed adjacent to the circumference of said space and axially spaced from said first pair of single layer concentric coil portions;

wherein each coil of said second pair includes a conductor which extends longitudinally along a third portion of said stator structure, loops back, and extends longitudinally along a fourth portion of said stator structure, said fourth stator portion being circumferentially displaced from said third stator portion;

means for producing a second rotating magnetic field which rotates in the opposite direction of said first magnetic field and induces a second voltage in said second pair of coil portions; and wherein said means for electrically connecting said first pair of concentric coil portions in parallel also serves as means for electrically connecting said second pair of coil portions in parallel with each other and in parallel with said first pair of concentric coil portions.

4. An electromagnetic projectile launcher as recited in claim 3, wherein said stator structure defines a plurality of axially extending slots disposed at circumferentially spaced locations adjacent to the circumference of said space and said first and second pairs of single layer concentric coil portions pass through said slots.

5. An electromagnetic projectile launcher as recited in claim 3, wherein said means for producing a first rotating magnetic field comprises:

a first rotor being rotatably mounted on the central axis of said space;

a first field winding attached to said first rotor.

6. An electromagnetic projectile launcher as recited in claim 5, wherein said means for producing a second rotating magnetic field comprises:

a second rotor being rotatably mounted on the central axis of said space and being axially displaced from said first rotor;

a second field winding attached to said second rotor.

7. An electromagnetic projectile launcher as recited in claim 6, further comprising: a damper winding attached to each of said rotors.

8. An electromagnetic projectile launcher as recited in claim 6, wherein said rotors rotate synchronously.

9. A high current alternator, comprising:

a stator structure having an internal space;

a first pair of single layer concentric coil portions disposed adjacent to the circumference of said space;

means for electrically connecting said first pair of concentric coil portions in parallel;

wherein each of said coil portions includes a conductor which extends longitudinally along a first portion of said stator structure, loops back, and extends longitudinally along a second portion of said stator structure, said second stator portion being circumferentially displaced from said first stator portion; and means for producing a first rotating magnetic field within said space, thereby inducing a voltage in said first pair of coil portions.

10. A high current alternator as recited in claim 9, wherein adjacent longitudinal sections of said conductors in a first one of said pair of concentric coil portions and in a second one of said pair of concentric coil portions are equally spaced in a circumferential direction to eliminate circulating currents due to said induced voltage.

11. A high current alternator as recited in claim 9, further comprising:

a second pair of single layer concentric coil portions disposed adjacent to the circumference of said space and axially spaced from said first pair of single layer concentric coil portions;

wherein each coil portion of said second pair includes a conductor which extends longitudinally along a third portion of said stator structure, loops back, and extends longitudinally along a fourth portion of said stator structure, said fourth stator portion being circumferentially displaced from said third stator portion;

means for producing a second rotating magnetic field which rotates in the opposite direction of said first magnetic field and induces a second voltage in said second pair of coil portions; and wherein said means for electrically connecting said first pair of concentric coil portions in parallel also serves as means for electrically connecting said second pair of coil portions in parallel with each other and in parallel with said first pair of concentric coil portions.

12. A high current alternator as recited in claim 11, wherein said stator structure defines a plurality of axially extending slots disposed at circumferentially spaced locations adjacent to the circumference of said space and said first and second pairs of single layer concentric coil portions pass through said slots.

13. A high current alternator as recited in claim 11, wherein said means for producing a first rotating magnetic field comprises:

a first rotor being rotatably mounted on the central axis of said space;

a first field winding attached to said rotor.

14. A high current alternator as recited in claim 13, wherein said means for producing a second rotating field comprises:

a second rotor being rotatably mounted on the central axis of said space and being axially displaced from said first rotor;

a second field winding attached to said second rotor.

15. A high current alternator as recited in claim 14, further comprising:

a damper winding attached to each of said rotors.

16. A high current alternator as recited in claim 14, wherein said first and second rotors rotate synchronously in opposite directions.

* * * * *